US009678459B2

(12) United States Patent
Suzuki

(10) Patent No.: US 9,678,459 B2
(45) Date of Patent: Jun. 13, 2017

(54) IMAGE FORMING APPARATUS

(71) Applicant: CANON KABUSHIKI KAISHA, Tokyo (JP)

(72) Inventor: Kenji Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/675,946

(22) Filed: Apr. 1, 2015

(65) Prior Publication Data

US 2015/0286165 A1 Oct. 8, 2015

(30) Foreign Application Priority Data

Apr. 2, 2014 (JP) ..... 2014-076285

(51) Int. Cl.
*G03G 15/20* (2006.01)
*G03G 15/16* (2006.01)

(52) U.S. Cl.
CPC ..... *G03G 15/1685* (2013.01); *G03G 15/167* (2013.01); *G03G 15/1615* (2013.01); *G03G 2215/00139* (2013.01); *G03G 2215/1623* (2013.01)

(58) Field of Classification Search
CPC ..... G03G 15/1655; G03G 15/167; G03G 15/1685; G03G 2215/00139; G03G 2215/1623
USPC ..... 399/302, 308, 313
See application file for complete search history.

(56) References Cited

U.S. PATENT DOCUMENTS 3,999,038 A * 12/1976 Sikes et al. ..... 432/60
5,344,520 A * 9/1994 Seki et al. ..... 156/472
8,577,268 B2 11/2013 Torimaru
8,838,012 B2 9/2014 Torimaru
2004/0154146 A1* 8/2004 Pruitt, Jr. ..... 26/99
2009/0279906 A1* 11/2009 Kuma ..... B65H 5/062 399/21
2011/0013950 A1* 1/2011 Furuya ..... G03G 15/167 399/302

(Continued)

FOREIGN PATENT DOCUMENTS

JP 07-225523 A 8/1995
JP 9-297469 A 11/1997

(Continued)

OTHER PUBLICATIONS

Search Report in European Patent Application No. 15162205.7, dated Sep. 29, 2015.

(Continued)

*Primary Examiner* — Benjamin Schmitt
(74) *Attorney, Agent, or Firm* — Fitzpatrick, Cella, Harper & Scinto

(57) ABSTRACT

A first stretch roller stretches a secondary transfer belt at a position where a tip in a conveying direction of a recording medium being conveyed through a secondary transfer portion can reach. The first stretch roller has a circumferential surface formed into a normal crown shape in which a straight area where a diameter of the first stretch roller is constant is provided at a center part in a direction of axis of rotation. A second stretch roller has a circumferential surface formed into an inverse crown shape in which a straight area where a diameter of the second stretch roller is constant is provided at a center part in a direction of axis of rotation.

8 Claims, 8 Drawing Sheets

(56) References Cited

U.S. PATENT DOCUMENTS

| | | | | |
|---|---|---|---|---|
| 2011/0135354 | A1* | 6/2011 | Maruko et al. | 399/329 |
| 2011/0142502 | A1* | 6/2011 | Torimaru | 399/312 |

FOREIGN PATENT DOCUMENTS

| | | | | | |
|---|---|---|---|---|---|
| JP | 09297469 | A | * | 11/1997 | G03G 15/14 |
| JP | 2003-201037 | A | | 7/2003 | |
| JP | 2005-345627 | A | | 12/2005 | |
| JP | 2005345627 | A | * | 12/2005 | G03G 15/16 |
| JP | 2010-276906 | A | | 12/2010 | |
| JP | 2011-013950 | A | | 1/2011 | |
| JP | 2011-059259 | A | | 3/2011 | |
| JP | 2011-123254 | A | | 6/2011 | |
| JP | 2011-123417 | A | | 6/2011 | |
| JP | 2011-141432 | A | | 7/2011 | |
| JP | 2012-128228 | A | | 7/2012 | |

OTHER PUBLICATIONS

Office Action dated Feb. 4, 2017, in Chinese Patent Application No. 201510150476.8.

* cited by examiner

IMAGE FORMING APPARATUS

BACKGROUND OF THE INVENTION

Field of the Invention

The present invention relates to an image forming apparatus configured to transfer a toner image carried on an image carrier to a recording medium carried on a transfer belt.

Description of the Related Art

Hitherto, there is widely known an image forming apparatus configured to pass a recording medium through a transfer portion while carrying the recording medium on a transfer belt and to transfer a toner image carried on an intermediate transfer belt, i.e., one example of an image carrier, to the recording medium carried on the transfer belt in a transfer portion as disclosed in Japanese Patent Application Laid-open No. 2012-128228.

If the recording medium has low rigidity like a thin sheet or has been already waving-deformed, there is a case when the recording medium is wrinkled in passing through the transfer portion to transfer the toner image in the image forming apparatus using the transfer belt.

Then, there is proposed an arrangement in which an outer circumferential surface of a transfer roller formed into a shape of an inversed crown is brought into pressure contact with the image carrier through an intermediary of the transfer belt. As disclosed in Japanese Patent Application Laid-open No. Hei. 7-225523, a conveying speed of end parts in a direction of axis of rotation of the transfer roller whose outer circumferential surface is formed into the inversed crown shape increases more than a conveying speed of a center part thereof, a rear end side of the recording medium passing through the transfer portion is spread in the direction of axis of rotation. This arrangement might be expected to exhibit an effect of smoothing wrinkles on both end parts and rear end portion in a conveying direction of the recording medium and to reduce wrinkles otherwise generated on the both end parts and the rear end portion in the conveying direction of the recording medium.

SUMMARY OF THE INVENTION

An image forming apparatus of the present invention includes an image carrier, a toner image forming unit configured to form a toner image on the image carrier, an endless transfer belt configured to convey a recording medium, a transfer roller forming a transfer portion configured to urge toward the image carrier from an inner circumferential surface of the transfer belt across the transfer belt, a first stretch roller stretching the transfer belt, disposed at a position adjacent to and downstream of the transfer portion in a moving direction of the transfer belt, and including a first straight area disposed at a center part in a direction of an axis of rotation thereof where a diameter is substantially constant and first tapered areas disposed on both end parts in the direction of the axis of rotation where the diameter is smaller than the first straight area such that the closer to both ends, the smaller the diameter becomes, and a second stretch roller stretching the transfer belt, disposed at a position adjacent to and downstream of the first stretch roller in the moving direction of the transfer belt, and including a second straight area disposed at a center part in a direction of an axis of rotation thereof where a diameter is substantially constant and second tapered areas disposed on both end parts in the direction of the axis of rotation where the diameter is larger than the second straight area such that the closer to both ends, the larger the diameter becomes.

Further features of the present invention will become apparent from the following description of exemplary embodiments (with reference to the attached drawings).

DESCRIPTION OF THE EMBODIMENTS

Embodiments of an image forming apparatus of the present invention will be described in detail below with reference to the drawings.

First Embodiment

Figure 1:
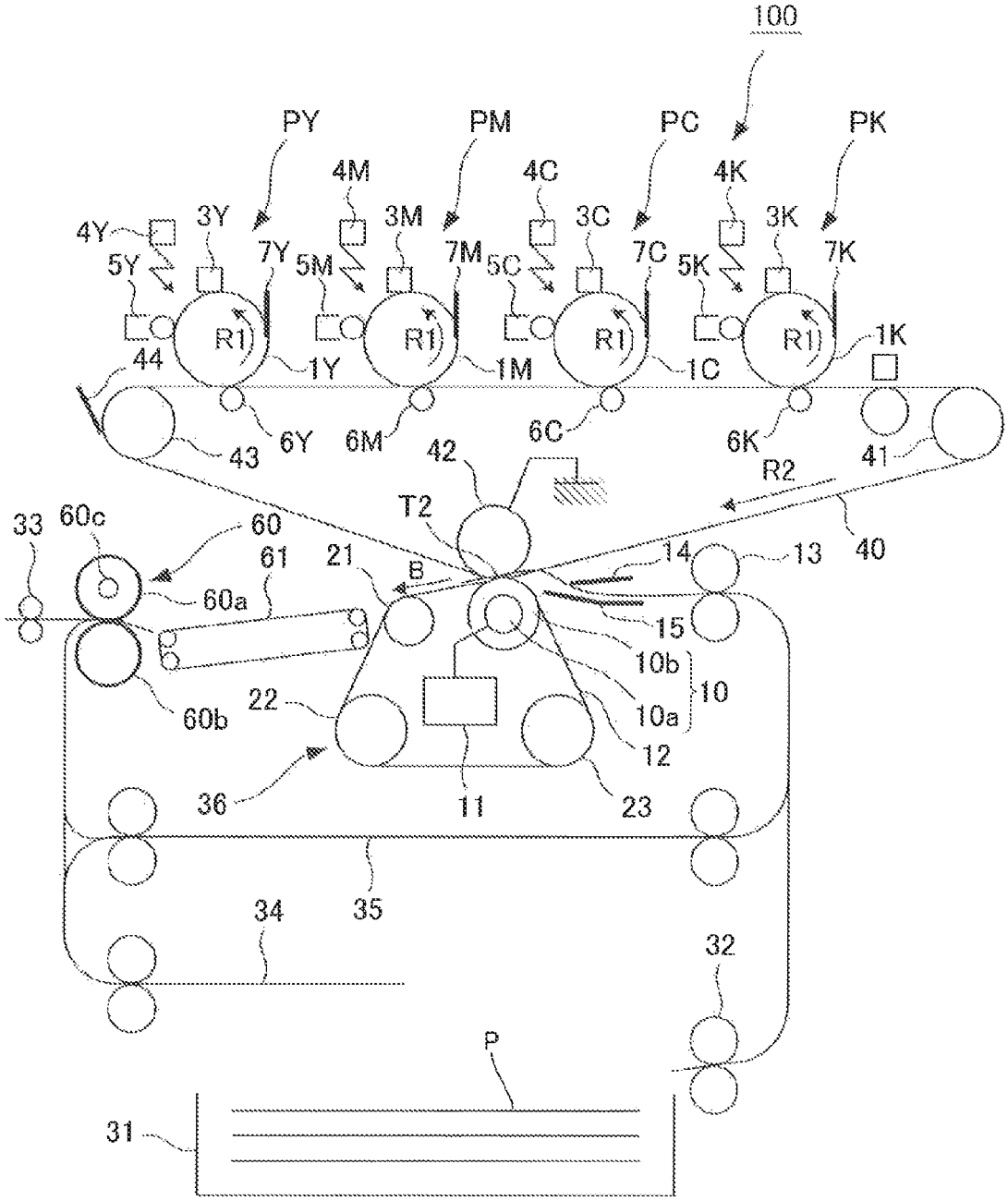
FIG. 1 is a schematic diagram illustrating a configuration of an image forming apparatus of a first embodiment.
Figure 4:
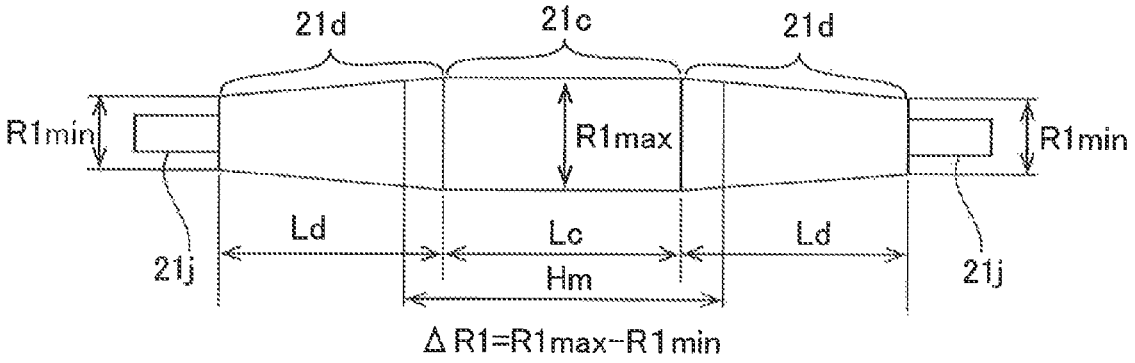
FIG. 4 illustrates a shape of a circumferential surface of a first stretch roller.
Figure 5:
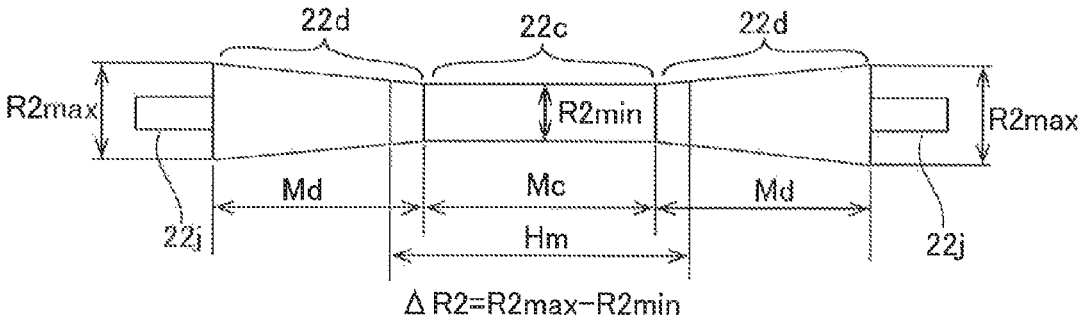
FIG. 5 illustrates a shape of a circumferential surface of a second stretch roller.

As shown in FIG. 1, a first stretch roller 21 is disposed downstream of a secondary transfer roller 10 in the image forming apparatus 100 of the first embodiment. As shown in FIG. 4, the first stretch roller 21 includes a straight area 21*c*, where a diameter of the first stretch roller 21 is constant, at a center part in a direction of rotational axis thereof and tapered areas 21*d*, where the diameter of the first stretch roller 21 is reduced toward the respective ends, disposed at both end parts of the straight area 21*c*. Then, a second stretch roller 22 is disposed downstream of the first stretch roller 21. As shown in FIG. 5, the second stretch roller 22 includes a straight area 22*c*, where a diameter of the second stretch roller 22 is constant, at a center part in a direction of rotational axis thereof and tapered areas 22*d*, where the diameter of the second stretch roller 22 is increased toward the respective ends, disposed at both end parts of the straight area 22*c*. The first stretch roller 21 suppresses wrinkles from being otherwise generated on the recording medium P passing through a secondary transfer portion T2 by deforming the secondary transfer belt 12 such that a center part thereof projects upward. The second stretch roller 22 whose circumferential surface is formed into the shape of the inversed crown enhances the effect of suppressing the wrinkles by improving adhesion of the secondary transfer belt 12 at the both ends of the first stretch roller 21.

<Image Forming Apparatus>

FIG. 1 is a diagram schematically showing a configuration of the image forming apparatus 100. As shown in FIG. 1, the image forming apparatus 100 is a tandem intermediate transfer type full-color printer in which image forming portions PY, PM, PC, and PK of process cartridges are arrayed along an upper surface of an intermediate transfer belt 40.

In the image forming portion PY, a yellow toner image is formed on a photosensitive drum 1Y and is then transferred to the intermediate transfer belt 40. In the image forming portion PM, a magenta toner image is formed on a photosensitive drum 1M and is then transferred to the intermediate transfer belt 40. In the image forming portions PC and PK, cyan and black toner images are formed respectively on photosensitive drums 1C and 1K and are then transferred to the intermediate transfer belt 40.

The four color toner images transferred on the intermediate transfer belt 40 are conveyed to a secondary transfer portion T2 to be secondarily transferred to a recording medium P. The recording medium P is picked up out of a recording medium cassette 31, separated one by one by a separation roller 32 and is then delivered to a registration roller 13. The registration roller 13 delivers the recording medium P to the secondary transfer portion T2 in synchronism with the toner images on the intermediate transfer belt 40.

The secondary transfer belt 12 whose inner surface is supported by the secondary transfer roller 10 of the secondary belt unit 36 forms a secondary transfer portion T2 by coming into contact with the intermediate transfer belt 40 whose inner surface is supported by a secondary transfer inner roller 42. The toner images on the intermediate transfer belt 40 are secondarily transferred to the recording medium P which has been conveyed to the secondary transfer portion T2 by applying voltage to a secondary transfer roller 10. Here, maximum reflection density of each color toner image transferred to the recording medium P is around 1.5 to 1.7 and a toner applied amount of the toner images at the maximum reflection density is around 0.4 to 0.6 mg/cm$^2$.

The recording medium P on which the four color toner images have been secondarily transferred is conveyed to a pre-fixing conveyor (conveying belt 61) to be delivered to a fixing apparatus 60. The image is fixed on a surface of the recording medium P under pressure and heat in the fixing apparatus 60. In the fixing apparatus 60, the toner images are melted and fixed to the recording medium P by the predetermined pressure and heat applied at a nip formed between a fixing roller 60*a* including a heater 60*c* and a pressure roller 60*b*.

(Duplex Printing Mode)

In a one-side printing mode, the recording medium P which has passed through the fixing apparatus 60 is discharged out of the apparatus body as it is through a discharge roller 33. Meanwhile, in a duplex printing mode, the recording medium P is fed again to the secondary transfer portion T2 such that a second surface (back surface) of the recording medium P fixed once becomes an image forming surface to form images on both surfaces of the recording medium P. The duplex printing mode enables to cut a consumption of recording media by forming images on both surfaces of the recording media.

In the duplex printing mode, the recording medium P which has passed through the fixing apparatus 60 is delivered to a reverse conveying path 34 and is conveyed to a duplex conveying path 35 after switching front and rear ends by performing a switch-back operation at the reverse conveying path 34. The recording medium P is conveyed through the duplex conveying path to the registration roller 13 and again to the secondary transfer portion T2. The recording medium P on which four color toner images have been secondarily transferred also on the back surface (second surface) thereof and whose image has been fixed is discharged out of the apparatus body through the discharge roller 33. In the duplex printing mode, wrinkles are apt to be generated on the recording medium in secondarily transferring the toner images as described later.

(Image Forming Portion)

The image forming portions PY, PM, PC, and PK have substantially the same configuration except that colors of toners used in developing apparatuses 5Y, 5M, 5C, and 5K are different as yellow, magenta, cyan and black. Accordingly, the following explanation will be made on the image forming portion PY and overlapped explanation concerning the other image forming portions PM, PC, and PK will be omitted here.

The image forming portion PY includes a charging apparatus 3Y, an exposure apparatus 4Y, the developing apparatus 5Y, a primary transfer roller 6Y and a drum cleaning device 7Y around the photosensitive drum 1Y. The photosensitive drum 1Y has a photosensitive layer formed around an outer circumferential surface of an aluminum cylinder and rotates in a direction of an arrow R1 in FIG. 1 at a predetermined process speed.

The charging apparatus 3Y electrifies the photosensitive drum 1Y with homogeneous negative potential. The exposure apparatus 4 scans, by a rotational mirror, a laser beam generated based on an image signal, i.e., image data developed to a scan line, to draw an electrostatic latent image on a surface of the photosensitive drum 1Y. The developing apparatus 5Y moves toner to the photosensitive drum 1Y to develop the electrostatic latent image as a toner image. A developer replenishing portion not shown replenishes an amount of toner consumed from the developing apparatus 5Y for the image forming operation to the developing apparatus 5Y.

The primary transfer roller 6Y presses the intermediate transfer belt 40 and forms a primary transfer portion between the photosensitive drum 1Y and the intermediate transfer belt 40. In response to application of positive DC voltage to the primary transfer roller 6Y, the negative toner image carried on the photosensitive drum 1Y is transferred to the intermediate transfer belt 40. The cleaning device 7Y recovers transfer residual toner adhering on the surface of the photosensitive drum 1Y by bringing in sliding contact a cleaning blade with the photosensitive drum 1Y.

As described above, the image forming portion PY, i.e., an exemplary toner image forming portion, is configured to form a toner image and makes the intermediate transfer belt 40, i.e., an exemplary image carrier, carry the toner image. The secondary transfer roller 10, i.e., an exemplary transfer roller, forms the portion for transferring the toner image to the recording medium by coming in pressure contact with the intermediate transfer belt across the secondary transfer belt 12, i.e., an exemplary endless transfer belt.

(Intermediate Transfer Belt)

The intermediate transfer belt 40 is stretched by a driving roller 43, a tension roller 41 and a secondary transfer inner roller 42 and is rotated in a direction of an arrow R2 in FIG. 1 at 250 to 300 mm/sec. by being driven by the driving roller 43. The tension roller 41 controls tension of the intermediate transfer belt 40 substantially at constant by being urged outside by pressure springs not shown on both ends thereof. The secondary transfer inner roller 42 supports an inner surface of the intermediate transfer belt 40 passing through the secondary transfer portion T2. The belt cleaning device 44 recovers transfer residual toner on the surface of the intermediate transfer belt 40 by bringing in sliding contact a cleaning blade with the intermediate transfer belt 40.

The intermediate transfer belt 40 is formed of resin such as polyamide, polycarbonate or the like or various rubbers whose volume resistivity is modified to $1\times10^{9}$ to $1\times10^{14}$ [Ω·cm] by containing an adequate amount of carbon black as antistatic. A thickness of the intermediate transfer belt 40 is 0.07 to 0.1 mm.

(Upstream Guide)

A secondary transfer upstream upper guide 14 and a secondary transfer upstream lower guide 15 restricts a conveying path of the recording medium P conveyed from the registration roller 13 to the secondary transfer portion T2.

The secondary transfer upstream upper guide 14 restricts behaviors of the recording medium P approaching to the surface of the intermediate transfer belt 40. The secondary transfer upstream upper guide 14 guides the recording medium P at an upstream side of the secondary transfer portion T2 and overlaps the recording medium P to a predetermined position on the surface of the intermediate transfer belt 40.

The secondary transfer upstream lower guide 15 restricts behaviors of the recording medium P separating from the surface of the intermediate transfer belt 40. The secondary transfer upstream lower guide 15 guides the recording medium P at the upstream side of the secondary transfer portion T2 and overlaps the recording medium P to the predetermined position on the surface of the intermediate transfer belt 40.

(Secondary Transfer Belt Unit)

Figure 2:
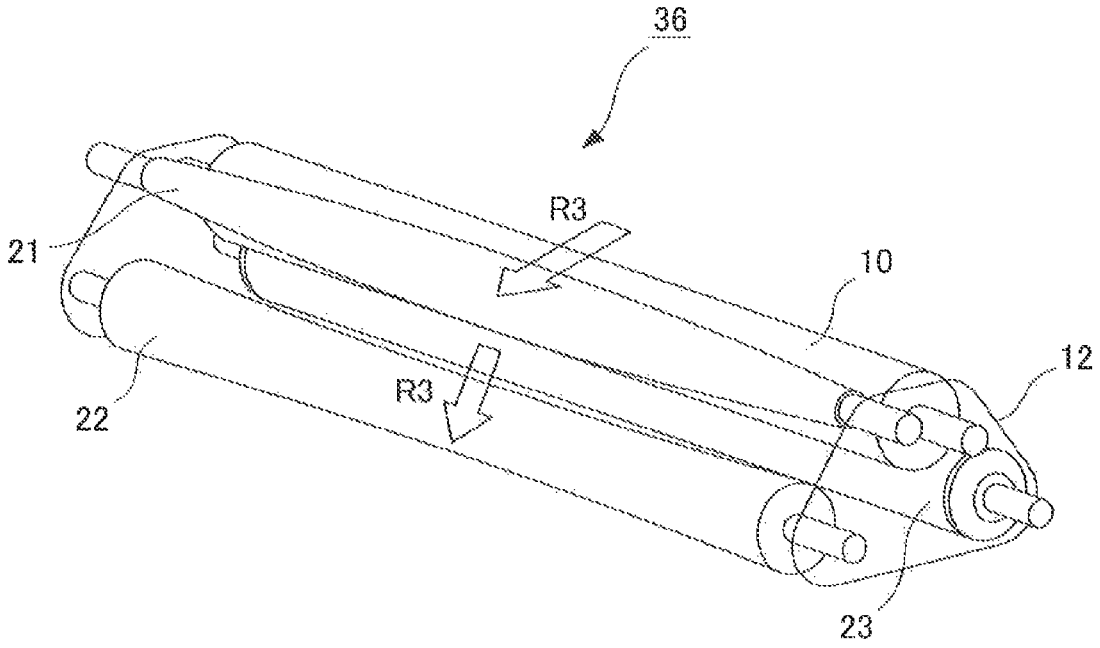
FIG. 2 is a perspective view of a secondary transfer belt unit according to the first embodiment.
Figure 3:
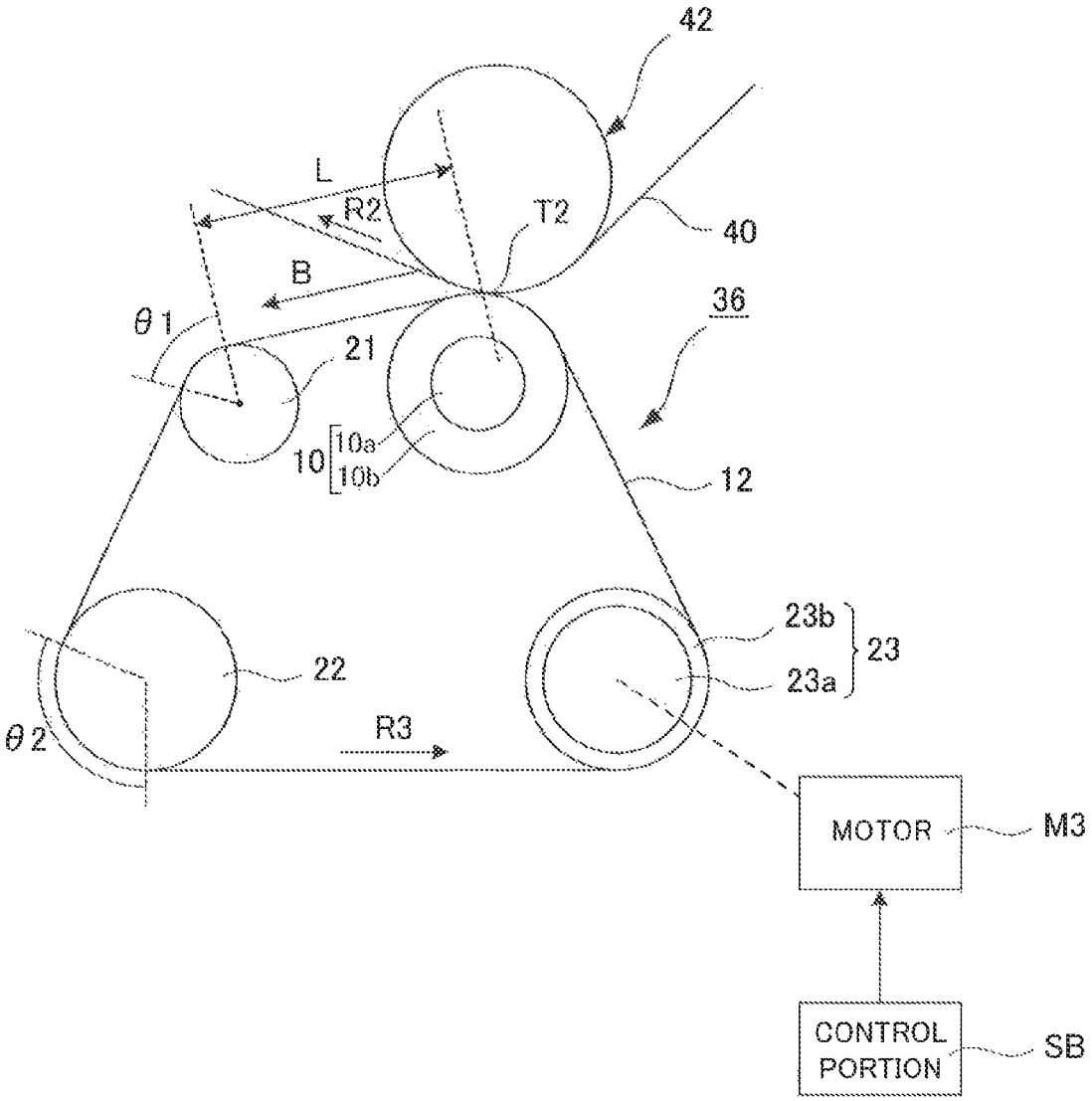
FIG. 3 illustrates a configuration of the secondary transfer belt unit of the first embodiment.

FIG. 2 is a perspective view of the secondary transfer belt unit 36. FIG. 3 is a schematic diagram showing a configuration of the secondary transfer belt unit 36. As shown in FIG. 1, the use of the secondary transfer belt 12 facilitates the recording medium P to separate from the intermediate transfer belt 40 after the transfer of the toner image in the secondary transfer portion T2 and enables the recording medium P to be conveyed stably to the fixing apparatus 60.

As shown in FIG. 2, the secondary transfer belt unit 36 is configured such that the secondary transfer belt 12 is wrapped around and supported by four stretch rollers, i.e., the secondary transfer roller 10, a first stretch roller 21, a second stretch roller 22, and a driving roller 23. The first stretch roller 21 is disposed downstream of the secondary transfer roller 10 in a rotation direction of the secondary transfer belt 12. The second stretch roller 22 is disposed downstream of the first stretch roller 21. The driving roller 23 is disposed downstream of the second stretch roller 22. The secondary transfer roller 10 is disposed downstream of the driving roller 23.

The secondary transfer belt 12 shown in FIG. 3 has a layer made of a resin material or a metallic material. The secondary transfer belt 12 is formed of a resin material whose volume resistivity is modified to $1\times10^{9}$ to $1\times10^{14}$ [Ω·cm] by containing an adequate amount of carbon black as antistatic to resin such as polyamide, polycarbonate or the like. The secondary transfer belt 12 has a mono-layer structure and its thickness is 0.07 to 0.1 mm. A value of Young's modulus of the secondary transfer belt 12 measured by a tensile test (JIS K 6301) is more than 100 MPa and less than 10 GPa.

(Secondary Transfer Roller)

As shown in FIG. 3, the secondary transfer roller 10 is formed to have an outer diameter of 20 mm by disposing an elastic layer 10*b* of ion conductive foaming rubber (NBR rubber) around a core metal 10*a* of stainless round bar. Surface roughness of the elastic layer 10*b* of the secondary transfer roller 10 is Rz=6.0 to 12.0 μm. A resistance value thereof measured by applying 2 kV in a normal temperature and normal humidity environment (N/N: 23° C., 50% RH) is $1\times10^{5}$ to $1\times10^{7}$Ω. Asker-C hardness of the elastic layer 10*b* is around 30 to 40.

The secondary transfer roller 10 is connected with a secondary transfer power supply 11 whose output current is variable. The secondary transfer power supply 11 automatically adjusts output voltage such that a transfer current of +40 to 60 μA flows for example. The secondary transfer power supply 11 forms a transfer electric field between the intermediate transfer belt 40 and the secondary transfer belt 12 by applying the voltage to the secondary transfer roller 10 to secondarily transfer the toner image carried on the intermediate transfer belt 40 to the recording medium P carried on the secondary transfer belt 12. The recording medium P is adsorbed to the secondary transfer belt 12 by an electrostatic force supplied from the secondary transfer power supply 11 in conjunction with the secondary transfer of the toner image.

The secondary transfer belt 12 conveys the recording medium P adsorbed on the surface of the secondary transfer belt 12 in conjunction with the secondary transfer of the toner image downstream from the secondary transfer portion T2 by rotating in a direction of an arrow B in FIG. 1.

While the secondary transfer roller 10 is a roller whose cross section is formed substantially into a straight shape, actually the secondary transfer roller 10 has a slight normal crown shape of around 200 to 300 μm in cross section around a circumferential surface thereof. The reason why the secondary transfer roller 10 is formed into the normal crown shape is to offset a deflection of the secondary transfer roller 10 supported at both ends and to prevent a drop of pressure of a center part of the secondary transfer roller 10 in a direction of axis of rotation in the secondary transfer portion T2.

Because the secondary transfer belt 12 and the intermediate transfer belt 40 are supported by the secondary transfer inner roller 42 formed into a straight shape, the secondary transfer portion T2 is flat when the secondary transfer roller 10 is brought into pressure contact with the secondary transfer inner roller 42 as shown in FIG. 1. By being pressed by the secondary transfer belt 12 and the intermediate transfer belt 40, center part in the direction of axis of rotation of the secondary transfer roller 10 deflects downward by 200 to 300 μm.

(Driving Roller)

As shown in FIG. 3, the driving roller 23 rotates the secondary transfer belt 12 in a direction of an arrow R3 by being driven by a motor M3. In order to be able to adjust a difference of speeds of the secondary transfer belt 12 and the intermediate transfer belt 40, a driving system of the secondary transfer belt is provided independently from a driving system of the intermediate transfer belt 40. The driving roller 23 is provided with a thin rubber layer 23*b* fixed to a circumferential surface of a metallic roller 23*a* to assure a friction force to the secondary transfer belt 12 so that no slip is caused between the secondary transfer belt 12 and the driving roller 23 in driving the driving roller 23.

The driving roller 23 is formed such that its circumferential surface is formed into a straight shape with an outer diameter of 20 to 24 mm and rotatably drives the secondary transfer belt 12. The secondary transfer belt 12 is adhered to circumferential surfaces of the first and second tension rollers 21 and 22 by stretching the secondary transfer belt 12 by the driving roller 23 formed into the straight shape.

(First Stretch Roller)

FIG. 4 illustrates a shape of a circumferential surface of the first stretch roller 21. As shown in FIG. 1, the first stretch roller 21 is a stretch roller of the secondary transfer belt 12 disposed downstream of the secondary transfer roller 10 in a rotation direction of the secondary transfer belt 12. The first stretch roller 21 functions also as a roller for separating the recording medium P adsorbed on the surface of the secondary transfer belt 12. The recording medium P adsorbed on the surface of the secondary transfer belt 12 is separated from the surface of the secondary transfer belt 12 by a curvature of a curved surface of the secondary transfer belt 12 running along the first stretch roller 21 and is passed to the pre-fixing conveyer 61.

As shown in FIG. 4, the first stretch roller 21 includes the straight area (first straight area) 21*c* with a length Lc disposed at a center part in a direction of axis of rotation thereof and the tapered areas (first tapered areas) 21*d* with a length Ld disposed on both end parts in the direction of axis of rotation. The straight area 21*c* is a straight area where a diameter of the first stretch roller 21 is constant. The tapered area 21*d* is formed into a truncated conical shape such that the diameter of the first stretch roller 21 is reduced linearly from the center side to the end parts. Parts between the straight area 21*c* and the tapered area 219*d* are continuously and smoothly formed into a circular arc so that no fold line is made on the secondary transfer belt 12.

The surface of the first stretch roller 21 is made of a hard metallic material manufactured by cutting a stainless round bar by a lathe. The first stretch roller 21 is substantially formed into a normal crown shape in which the diameter of the first stretch roller 21 is reduced hyperbolic from the center part in the direction of axis of rotation of the circumferential surface to the both ends. An outer diameter of a part of the first stretch roller 21 where the outer diameter is largest in the direction of axis of rotation will be denoted by R1max and an outer diameter of a part where the outer diameter is smallest will be denoted by R1min. An outer diameter of the straight area 21*c* of the first stretch roller 21 is R1max. Then, a difference of the outer diameters of the part where the outer diameter is largest and the part where the outer diameter is smallest will be defined as a normal crown amount ΔR1 as follows:

$$\Delta R1 = R1\max - R1\min$$

It has been confirmed by experiments that the greater the normal crown amount ΔR1, the greater the effect of eliminating wrinkles on the recording medium in the secondary transfer portion T2 is. As shown in FIG. 3, in the first embodiment, if a distance L from the secondary transfer portion T2 to the first stretch roller 21 is set to be 20 to 30 mm, the normal crown amount ΔR1 can be set at 1 to 3 mm. The outer diameter R1min of the part of the first stretch roller 21 where the outer diameter is smallest can be set at 10 to 16 mm. Specifically, the diameter of the straight area 21*c* is 18 mm and the diameter of the tapered area 21*d* at the center side is 18 mm and that at the both ends is 15 mm.

Because the circumferential surface of the first stretch roller 21 is formed substantially into the normal crown shape as described above, it is possible to pass the recording medium P which has caused waving by a certain degree in the fixing apparatus 60 through the secondary transfer portion T2 without generating wrinkles.

That is, the secondary transfer belt 12 stretched by the first stretch roller 21 approaches, downstream of the secondary transfer roller 10, to an axial line of rotation of the first stretch roller 21 gradually from the center part to the end part and is deformed such that the center part projects upward. The secondary transfer belt 12 deformed such that the center part thereof projects upward deforms the recording medium P such that the recording medium P projects upward at a position downstream of the secondary transfer roller 10. At this time, by being urged by the secondary transfer roller 10, such a force that reduces heights of waving and bulges of the recording medium formed at the side upstream of the secondary transfer portion T2 and causing wrinkles acts on the recording medium P in the secondary transfer portion T2 nipped in flat between the secondary transfer belt 12 and the intermediate transfer belt 40. Then, if the height of the waving and bulges of the recording medium P formed on the side upstream of the secondary transfer portion T2 is reduced, wrinkles are hard to be generated in passing through the secondary transfer portion T2.

Accordingly, it is possible to reduce the wrinkles otherwise generated in the secondary transfer portion T2 by forming the first stretch roller 21 such that the center part in the direction of axis of rotation projects more than the end parts, i.e., into such a shape that deforms the secondary transfer belt 12 such that the center part thereof projects to the surface side.

As shown in FIG. 4, a width of the straight area (=maximum outer diameter area) where the diameter of the center part of the first stretch roller 21 is constant is set to be narrower than a width of a recording medium of smallest size, i.e., a smallest sheet width or a length of a recording medium in the width direction orthogonal to the conveying direction is smallest, usable in the image forming apparatus 100. This arrangement makes it possible to exert the force lowering the height of the waving and bulges generated on the side upstream of the secondary transfer portion T2 as described above on the recording media of all kinds of size on which the image forming apparatus 100 can form an image.

Here, although a recording medium whose sheet width is short hardly causes wrinkles in passing through the secondary transfer portion T2 from the beginning because a length in the conveying direction is also short, it is possible to reliably prevent wrinkles from being generated by conveying the recording medium through the tapered areas 21*d* even a little.

Meanwhile, a recording medium whose sheet width is large often has a long length in the conveying direction and is liable to cause wrinkles in passing through the secondary transfer portion T2. However, because the tapered area 21*d* whose area is wide acts on the recording medium P whose sheet width is large, the wide tapered area 21*d* is suitable in preventing wrinkles otherwise from being generated in the secondary transfer portion T2. That is, the wide tapered area 21*d* makes it possible to exert the wrinkle preventing function on the recording medium corresponding to types (sheet width) of the recording media.

As described above, the first stretch roller 21, i.e., one exemplary first stretch roller, stretches the secondary transfer belt 12 at the position where a tip in the conveying direction of the recording medium being conveyed through the secondary transfer portion T2 can reach. The first stretch roller 21 stretching the secondary transfer belt 12 includes the straight area 21*c* where the diameter of the first stretch roller 21 is constant at the center part in the direction of axis of rotation and the tapered areas 21*d* where the diameter of the first stretch roller 21 is smaller than that of the straight area 21*c* and the closer to the both ends, the smaller the diameter becomes at the both ends. The tapered areas 21*d* have the circumferential surface of the normal crown shape in which the diameter of the first stretch roller 21 becomes small continuously from the center part in the direction of axis of rotation to the both ends.

The first stretch roller 21 has the straight area 21*c* in a range corresponding to the straight area 22*c* of the second stretch roller 22 in the direction of axis of rotation and has the tapered areas 21*d* in a range corresponding to the tapered areas 22*d* of the second stretch roller 22 in the direction of axis of rotation. The straight area 21*c* is set inside more than widthwise edges orthogonal to the conveying direction of the smallest size recording medium conveyed to the secondary transfer portion T2.

(Second Stretch Roller)

FIG. 5 illustrates a circumferential surface of the second stretch roller 22. As shown in FIG. 2, the effect of suppressing wrinkles otherwise generated on the recording medium P in the secondary transfer belt 12 on the secondary transfer belt 12 by the first stretch roller 21 provided downstream of the secondary transfer portion T2 declines considerably if the secondary transfer belt 12 conveying the recording medium P is not stretched so as to adhere the circumferential surface of the first stretch roller 21. However, because the secondary transfer belt 12 is formed of a resin material and is hard, it is not so easy to adhere the secondary transfer belt 12 around the circumferential surface curved in the direction of axis of rotation of the first stretch roller 21. Then, the second stretch roller 22 whose circumferential surface is formed substantially into an inverse crown shape is provided downstream of the first stretch roller 21 in the first embodiment.

The surface of the second stretch roller 22 is made of a hard metallic material manufactured by cutting a stainless round bar by a lathe. As shown in FIG. 5, the second stretch roller 22 includes the straight area (second straight area) 22*c* with a length Mc disposed at a center part in a direction of axis of rotation thereof and the tapered areas (second tapered areas) 22*d* with a length Md disposed on both end parts in the direction of axis of rotation. The straight area 22*c* is a straight area where a diameter of the second stretch roller 22 is constant. The tapered area 22*d* is formed into a truncated conical shape such that the diameter of the second stretch roller 22 increases linearly from the center side to the end part. Parts between the straight area 22*c* and the tapered area 22*d* are continuously and smoothly formed into a circular arc so that no fold line is made on the secondary transfer belt 12.

The second stretch roller 22 is substantially formed into the inversed crown shape in which the diameter of the second stretch roller 22 increases hyperbolic on the circumferential surface from the center part in the direction of axis of rotation to the both ends. An outer diameter of a part of the second stretch roller 22 where the outer diameter is largest will be denoted by R2max and an outer diameter of a part where the outer diameter is smallest will be denoted by R2min. Then, a difference of the outer diameters of the part where the outer diameter is largest and the part where the outer diameter is smallest will be defined as an inversed crown amount ΔR2 as follows:

$$\Delta R2 = R2\max - R2\min$$

In the first embodiment, ΔR2 can be set around at 1 to 3 mm by setting the outer diameter R2min of the part of the second stretch roller 22 where the outer diameter is smallest around at 16 to 22 mm. Specifically, the diameter of the straight area 22*c* is 20 mm and the diameter of the tapered area 22*d* at the center side is 20 mm and that at the both ends is 22 mm.

As shown in FIG. 3, an abutting angle of the secondary transfer belt 12 with the first stretch roller 21 will be denoted by θ1 and an abutting angle of the secondary transfer belt 12 with the second stretch roller 22 will be denoted by θ2. As described above, the normal crown amount of the first stretch roller 21 is ΔR1 and the inverse crown amount of the second stretch roller 22 is ΔR2. At this time, it is desirable to satisfy the following relational expression among ΔR1, ΔR2, θ1 and θ2 in order to wrap the secondary transfer belt 12 along the circumferential surface of the normal crown shape of the first stretch roller 21 while being stretched:

$$\Delta R1 \times \theta 1 \leq \Delta R2 \times \theta 2$$

As shown in FIG. 5, the second stretch roller 22 includes the straight area 22*c*, i.e., one exemplary straight area where the diameter of the second stretch roller 22 is equal, at the center part in the direction of axis of rotation. An outer diameter of the straight area 22*c* is R2min. A length Mc of the straight area 22*c* is set to be equal to the length Lc of the straight area 21*c* of the first stretch roller 21 shown in FIG. 4. Then, as shown in FIG. 2, the circumferential surface is formed on the tapered area 22*d* of the second stretch roller 22 located downstream of the first stretch roller 21 such that a difference of circumferential lengths of a rotational orbit of the secondary transfer belt 12 caused by the circumferential surface of the tapered area 21*d* of the first stretch roller 21 is offset.

This arrangement is made to equalize a circumferential length of the secondary transfer belt 12 stretched by the secondary transfer roller 10, the first stretch roller 21, the second stretch roller 22 and the driving roller 23 at least at the widthwise center and the both end parts of the secondary transfer belt 12. If the circumferential length of the secondary transfer belt 12 is equal at the widthwise center and both ends parts of the secondary transfer belt 12, the both end parts of the secondary transfer belt 12 adhere to the tapered areas 21*d* of the first stretch roller 21 without being partially loosened. If the both end parts of the secondary transfer belt 12 adhere to the tapered areas 21*d* of the first stretch roller 21 without looseness, it is possible to fully exhibit the effect of suppressing wrinkles otherwise from being generated in the secondary transfer portion T2 by the first stretch roller 21 as described above.

The circumferential surface of the tapered areas 22*d* of the second stretch roller 22 properly stretches the both widthwise end parts of the secondary transfer belt 12 and adheres the secondary transfer belt 12 to the circumferential surface of the tapered areas 21*d* of the first stretch roller 21, except for the areas adjacent to the straight area 21*c*. The widthwise center part of the secondary transfer belt 12 stretched by the first stretch roller 21 is deformed to project to be higher to the surface side by adhering the tapered area 21*d* of the first stretch roller 21 with the both widthwise end parts of the secondary transfer belt 12 without gap. This arrangement makes it possible to deform the recording medium carried on the secondary transfer belt 12 such that the widthwise center part projects to be higher than the both end parts in the first stretch roller 21 even if the secondary transfer belt 12 is formed of a hard resin material. Thereby, it is possible to suppress wrinkles otherwise generated in passing through the secondary transfer portion T2 by reducing the waving and bulges of the recording medium P generated upstream of the secondary transfer portion T2.

As described above, the second stretch roller 22, i.e., one exemplary second stretch roller, stretches the secondary transfer belt 12 on the side downstream of the first stretch roller 21 in the rotation direction of the secondary transfer belt 12. The second stretch roller 22 stretching the secondary transfer belt 12 includes the straight area 22*c* where the diameter of the second stretch roller 22 is constant at the center part in the direction of axis of rotation and the tapered areas 22*d* where the diameter of the second stretch roller 22 is larger than that of the straight area 22*c* and the closer to the both end parts, the larger the diameter becomes at the both end parts in the direction of axis of rotation. The tapered area 22*d* has the circumferential surface of the inverse crown shape in which the diameter of the second stretch roller 22 becomes large continuously from the center part in the direction of axis of rotation to the both end parts.

Then, at this time, a relationship of $LT1+LT2 \leq LC1+LC2$ holds as a tension assuring condition at the widthwise both end parts of the secondary transfer belt 12, where LT1 is a length ($\Delta R1min \times \theta 1$) of the widthwise end parts of the secondary transfer belt 12 wrapped around the tapered area 21*d*, LT2 is a length ($\Delta R2max \times \theta 2$) of the widthwise end part wrapped around the tapered area 22*d*, LC1 is a length ($\Delta R1max \times \theta 1$) of the widthwise center part of the secondary transfer belt 12 wrapped around the straight area 21*c*, and LC2 is a length ($\Delta R2min \times \theta 2$) of the widthwise center part wrapped around the straight area 22*c*.

(Comparative Experiment)

The secondary transfer belt unit 36 has been made in trial by differentiating the shape of the circumferential surface of the secondary transfer roller 10, the first stretch roller 21, the second stretch roller 22 and the driving roller 23 shown in FIG. 3. Then, the secondary transfer belt unit 36 made in trial has been mounted in the image forming apparatus 100 to compare states in which wrinkles are generated on a recording medium in a thin sheet duplex printing mode. It is because wrinkles are often generated on a recording medium in the thin sheet duplex printing mode as described later. It is noted that the secondary transfer roller 10 used in the experiment is formed slightly into the normal crown shape as described above, it is written as straight in substantial meaning.

TABLE 1

| ROLLER NAME | FIRST COMPARATIVE EXAMPLE | SECOND COMPARATIVE EXAMPLE | THIRD COMPARATIVE EXAMPLE |
|---|---|---|---|
| SECONDARY TRANSFER ROLLER | STRAIGHT | INVERSED CROWN SHAPE | STRAIGHT |
| FIRST STRETCH ROLLER | NORMAL CROWN SHAPE | STRAIGHT | INVERSED CROWN SHAPE |
| SECOND STRETCH ROLLER | INVERSED CROWN SHAPE | STRAIGHT | NORMAL CROWN SHAPE |
| DRIVING ROLLER | STRAIGHT | STRAIGHT | STRAIGHT |
| WRINKLE PREVENTING EFFECT | GOOD | FAIR | BAD |

As shown in Table 1, it is possible to obtain the effect of preventing wrinkle from generated on the recording medium in the first comparative example in which the whole circumferential surface of the first stretch roller 21 is formed into the shape of the normal crown and the whole circumferential surface of the second stretch roller 22 is formed into the shape of the inversed crown. Meanwhile, in the second comparative example in which the whole circumferential surface of the secondary transfer roller 10 is formed into the shape of the inversed crown, a large effect can be obtained with regard to the prevention of wrinkles as disclosed in Japanese Patent Application Laid-open No. Hei. 7-225523 in a case where there is no secondary transfer belt 12. However, there is no effect for preventing wrinkles in a state in which the secondary transfer belt 12 is stretched. Still further, in the third comparative example in which the whole circumferential surface of the first stretch roller 21 is formed into the shape of the inversed crown and the whole circumferential surface of the second stretch roller 22 is formed into the shape of the normal crown, an adverse effect is brought about and wrinkles are generated remarkably.

Accordingly, it is possible to enhance the effect of preventing wrinkles from being generated in the secondary transfer portion T2 by forming the circumferential surface of the first stretch roller 21 into the shape of the normal crown and the circumferential surface of the second stretch roller 22 into the shape of the inversed crown.

Next, the secondary transfer belt unit 36 of the first embodiment in which the first and second stretch rollers in the first comparative example are replaced with the first stretch roller 21 shown in FIG. 4 and the second stretch roller 22 shown in FIG. 5 has been made in trial. Then, the secondary transfer belt unit 36 of the first embodiment made in trial is mounted to the image forming apparatus 100 to compare, with the first comparative example, states in which wrinkles are generated on the recording medium in the thin sheet duplex printing mode. It is noted that in Table 2, the first and second stretch rollers of the first embodiment are written as (including straight area). The first and second stretch rollers of the first comparative example are written as (without straight area).

[Table 2]

TABLE 2

| ROLLER NAME | FIRST EMBODIMENT | FIRST COMPARATIVE EXAMPLE |
|---|---|---|
| SECONDARY TRANSFER ROLLER | STRAIGHT | STRAIGHT |
| FIRST STRETCH ROLLER | NORMAL CROWN SHAPE (INCLUDING STRAIGHT AREA) | NORMAL CROWN SHAPE (WITHOUT STRAIGHT AREA) |
| SECOND STRETCH ROLLER | INVERSED CROWN SHAPE (INCLUDING STRAIGHT AREA) | INVERSED CROWN SHAPE (WITHOUT STRAIGHT AREA) |
| DRIVING ROLLER | STRAIGHT | STRAIGHT |
| WRINKLE PREVENTING EFFECT | VERY GOOD | GOOD |
| THIN SHEET SEPARATING EFFECT | VERY GOOD | GOOD |

As shown in Table 2, in the first embodiment in which the circumferential surface of the first stretch roller 21 is formed into the shape of the normal crown including the straight area and the circumferential surface of the second stretch roller 22 is formed into the shape of the inversed crown including the straight area is better than the first comparative example in terms of the effect of preventing winkles from otherwise being generated on the recording medium. Still further, the first embodiment is better than the first comparative example in terms of the thin sheet separating effect evaluating recording medium separability of the rollers.

Accordingly, the wrinkle preventing effect at the secondary transfer portion T2 is enhanced by forming the circumferential surface of the first stretch roller 21 into the shape of the normal crown including the straight area and the circumferential surface of the second stretch roller 22 into the shape of the inversed crown including the straight area. Still further, the recording medium separating effect at the curved surface of the secondary transfer belt 12 stretched by the first stretch roller 21 is also enhanced.

(Complementary Explanation of Comparative Example)

In the image forming apparatus disclosed in Japanese Patent Application Laid-open No. Hei. 7-225523, the circumferential surface of the transfer roller composing the toner image transfer portion is formed into the shape of the inversed crown to generate such a distribution of conveying speed that the widthwise end parts of the recording medium extend toward outside in the secondary transfer portion T2. This arrangement makes it possible to extend wrinkles of the recording medium toward outside at the nip portions of the secondary transfer portion and the fixing apparatus.

Accordingly, it is anticipated that even a recording medium that has generated waving in the fixing apparatus 60 generates no wrinkle in passing through the secondary transfer portion T2 if the circumferential surface of the secondary transfer roller 10 is formed into the shape of the inversed crown as shown in the second comparative example. However, no such effect exists in the second comparative example as described above. In a case when the secondary transfer belt 12 is wrapped around the secondary transfer roller 10 in order to stably convey the recording medium P, the secondary transfer belt 12 is deformed flat by a stretching tension and by the counterfacing secondary transfer inner roller 42. Therefore, it is assumed that it is unable to form a distribution of speed that extends wrinkles of the recording medium.

That is, it is unable to fully extend wrinkles of the recording medium by the shape of the inversed crown of the secondary transfer roller in a case when the secondary transfer belt is stretched by the secondary transfer roller whose circumferential surface is formed into the shape of the inversed crown. Uneven transfer is liable to occur by the wrinkles generated in the secondary transfer portion T2 caused by the waving generated in the fixing apparatus 60.

(Thin Sheet Duplex Printing Mode)

Figure 6A:
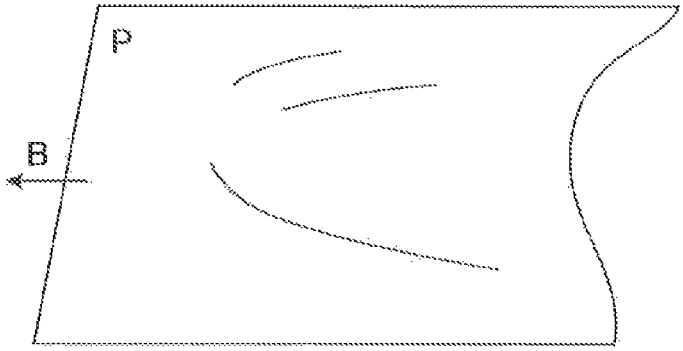
FIG. 6A illustrates a recording medium causing waving in a thin sheet duplex printing mode.
Figure 6B:
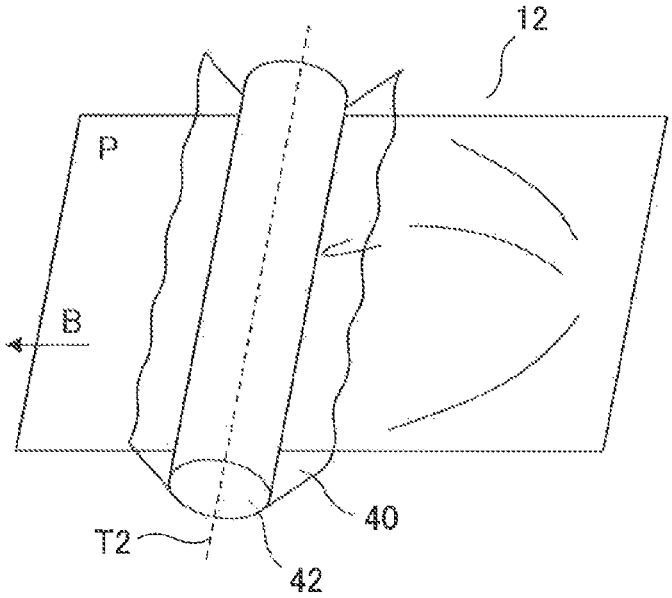
FIG. 6B illustrates a recording medium causing waving in the thin sheet duplex printing mode in a state in which a widthwise center part thereof bulges upward.
Figure 6C:
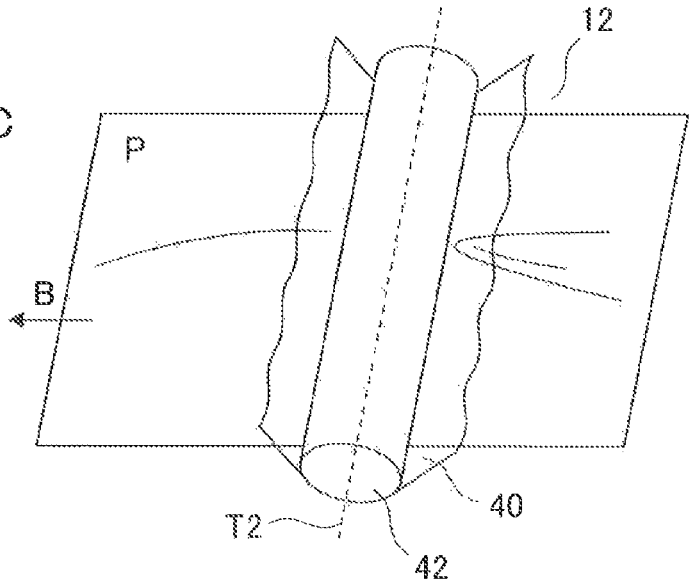
FIG. 6C illustrates a recording medium causing waving in the thin sheet duplex printing mode in a state in which the widthwise center part bulged upward is flattened by pressure of a nip.

FIGS. 6A through 6C illustrate states in which wrinkles are generated on a recording medium in a thin sheet duplex printing mode. As shown in FIG. 1, in the duplex printing mode, moisture is taken away from the recording medium P that has contained a certain amount of moisture when heat and pressure are applied in the fixing apparatus 60 to fix the toner image to the recording medium P in a first time, and then the recording medium P quickly absorbs moisture from an ambient environment. Because the change of the moisture content of the recording medium P abruptly occurs before and after passing through the fixing apparatus 60, there is a case when fibers of the recording medium P extend and contract partly, causing waving on the recording medium. Because the change of the moisture content is remarkable at the end parts as compared to that of the center part of the recording medium, the both end parts of the recording medium are prolonged as compared to the center part and a phenomenon called waving, i.e., waves are generated on the end parts, is liable to occur on the recording medium P which has passed through the fixing apparatus 60.

Then, when the recording medium P is conveyed again to the secondary transfer portion T2 to transfer a toner image on the back surface of the recording medium P which has caused the waving, the waving parts of the end parts of the recording medium P come closer to the center to try to adjust its length and changes to wrinkles when the recording medium passes through the secondary transfer portion T2. If wrinkles are generated remarkably in the secondary transfer portion T2, the recording medium itself is folded by the wrinkles if the recording medium is brittle. Even if the recording medium is not folded, uneven transfer of the toner image occurs between the parts on which the wrinkles are generated and not generated, quality of an output image is surely damaged. Waving of the recording medium generated in the fixing apparatus 60 occurs more in the thin sheet whose rigidity is low and the uneven transfer caused by the wrinkles generated in the secondary transfer portion T2 due to waving is liable to be more generated on the thin sheet.

More specifically, FIG. 6A illustrates a state of the recording medium P causing waving in which a length in the conveying direction of the widthwise both end parts orthogonal to the conveying direction is longer than a length of the widthwise center part of the recording medium P. If the recording medium P causing waving is pasted to the surface of the flat secondary transfer belt 12 as shown in FIG. 6B, the widthwise center part of the recording medium bulges and projects upward so as to separate from the secondary transfer belt 12 due to a difference of the lengths in the conveying direction of the both end parts and the center part. If the recording medium P is conveyed to the nip of the secondary transfer portion T2 in the state in which the widthwise center part of the recording medium P is bulged, the bulge of the widthwise center part is brought to the upstream side, i.e., on an opposite side from the conveying direction B. Then, if the bulge at the widthwise center part becomes unable to bear the pressure of the nip of the secondary transfer portion T2, the bulge at the widthwise center part is crushed by the pressure of the nip and becomes wrinkles as shown in FIG. 6C.

Whereas, the first stretch roller 21 stretching the secondary transfer belt 12 at the side downstream of the secondary transfer portion T2 is formed such that the center part in the direction of axis of rotation thereof deforms the secondary transfer belt 12 such that the secondary transfer belt 12 projects on the surface side more than the end parts thereof. The normal crown shape is one example of such shape. Due to that, the secondary transfer belt 12 in a section from the secondary transfer portion T2 to the first stretch roller 21 is deformed such that the widthwise center part orthogonal to the rotation direction bulges upward.

While the recording medium P is deformed to project upward on the downstream side, a force projecting downward acts on the recording medium P by reaction during a section from a downstream part in which the recording medium P projects upward to the secondary transfer portion T2 in a state in which the recording medium P is nipped straightly in the upstream secondary transfer portion T2.

The force acting on the recording medium P to deform and project downward in the secondary transfer portion T2 reduces the bulge projecting upward which causes the wrinkles in the secondary transfer portion T2. Accordingly, it is possible to reduce the wrinkles generated in the secondary transfer portion T2 by forming the circumferential surface of the first stretch roller 21 located downstream of the secondary transfer portion T2 so as to be able to deform the center part in the direction of axis of rotation of the secondary transfer belt 12 to project to the surface side more than the both end parts.

Advantageous Effects of First Embodiment

According to the first embodiment, the straight area 21*c* and the tapered areas 21*d* are disposed on the circumferential surface of the first stretch roller 21, so that the widthwise center part of the secondary transfer belt 12 is deformed to project on the surface side more than the both end parts and wrinkles are hardly generated on the recording medium P. Wrinkles are hardly generated also on a thin recording medium and also in the duplex printing mode. Even if the recording medium P supplied to the secondary transfer portion T2 is in a state causing waving by passing through the fixing apparatus 60 once, it is possible to reliably reduce inferior images otherwise caused by wrinkles in the secondary transfer portion T2 due to waving.

According to the first embodiment, the straight area 22*c* and the tapered areas 22*d* are disposed on the circumferential surface of the second stretch roller 22, so that the widthwise both end parts of the secondary transfer belt 12 are intensively stretched and the secondary transfer belt 12 comes into contact with the both end parts of the first stretch roller 21 without gap. Therefore, the abovementioned wrinkle suppressing effect brought about by disposing the straight area 21*c* and the tapered areas 21*d* on the circumferential surface of the first stretch roller 21 is enhanced. Because the effect of stretching the wrinkles of the recording medium P by the first stretch roller 21 becomes remarkable, inferior images caused by wrinkles due to waving generated in the fixing apparatus 60 is also reduced.

According to the fist embodiment, because the first stretch roller 21 functions also as the separating roller forming the curved surface of the secondary transfer belt 12 for curvature-separating the recording medium P from the secondary transfer belt 12, it is not necessary to dispose an independent separating roller on the side downstream of the first stretch roller 21. Therefore, a number of components of the secondary transfer belt unit 36 can be cut, allowing the unit to be downsized. Then, because the straight area 21*c* is provided on the circumferential surface of the first stretch roller 21, a widthwise curve of the recording medium P is more acute than the case where there is no straight area 21*c*. Due to that, rigidity of the recording medium P at the curved surface of the secondary transfer belt 12 stretched by the first stretch roller 21 is enhanced and its performance of separating from the secondary transfer belt 12 is enhanced more than the case where there is no straight area 21*c*.

It is noted that from the aspect of the cut of the number of components, it is conceivable to configure the part from the secondary transfer portion T2 to the fixing apparatus 60 by one transfer belt unit as disclosed in Japanese Patent Application Laid-open No. 2011-123254. In the configuration, a conveying surface forming roller is disposed downstream of the first stretch roller 21 and an independent separating roller is disposed downstream of the conveying surface forming roller. At this time, even if the straight area 21*c* and the tapered areas 21*d* are disposed on the circumferential surface of the first stretch roller 21, a thin sheet whose rigidity is low is conveyed while being absorbed by the secondary transfer belt 12. However, a thick sheet whose rigidity is high does not deform along the straight area 21*c* and the tapered areas 21*d* of the first stretch roller 21 and separates from the secondary transfer belt 12, so that the thick sheet cannot be conveyed stably on a side downstream of the first stretch roller 21.

Accordingly, if the recording media P, i.e., from the thin sheet to the thick sheet, are tried to be stably conveyed from the secondary transfer portion T2 to the fixing apparatus 60, it is desirable to dispose the first stretch roller 21 at the position close to the secondary transfer roller 10 as shown in FIG. 1 such that the first stretch roller 21 also functions as the separating roller. It is also desirable to convey the recording medium P by the pre-fixing conveyor 61, i.e., another conveying apparatus, in a space from the first stretch roller 21 to the fixing apparatus 60.

According to the first embodiment, the length Lc of the straight area 21*c* is set to be narrower than a minimum width permitting to form an image, so that it is possible to suppress wrinkles otherwise generated in passing through the secondary transfer portion T2 on all sizes of recording media on which an image can be formed by the image forming apparatus 100.

According also to the first embodiment, there is a merit in terms of machining by providing the straight area 21*c* on the circumferential surface of the first stretch roller 21. That is, because the first stretch roller 21 includes the straight area 21*c* at the center part in the direction of axis of rotation, it is possible to machine the circumferential surface by a lathe by chucking the straight area 21*c*. By providing the straight area 21*c* on the circumferential surface of the first stretch roller 21, a direction of a columnar material in which the straight area 21*c* has been formed can be reversed on a stage in which machining by the lathe is completed to a point passing through the straight area 21*c* from another end part by chucking one end part of the columnar material. The straight area 21*c* is chucked again to the lathe from an opposite side and machining of a remaining part of the first stretch roller 21 is started from the unfinished one end part of the columnar material.

In this case, the straight area 21*c* is chucked again by the time when the first stretch roller 21 is machined along the axis of rotation to the point passing through the straight area 21*c*, oscillation of a center of rotation and spiral motions can be reduced in machining the opposite side of the material by the lathe. As a result, machining accuracy of the first stretch roller 21 of a final product is enhanced and the shape is stabilized.

The adoption of such machining procedure allows even such long first stretch roller 21 of about 400 to 600 mm to be manufactured by machining the whole roller by the lathe. It is also possible to reduce eccentricity between a center axis and an outer circumstance and to machine a curve and others of an outer diameter along the axis of rotation in high precision. Still further, because it is possible to machine the circumferential surface in high precision in a short time by machining the circumferential surface of a rotating body by the lathe more than polishing, the high precision first stretch roller 21 can be manufactured in a shorter time than the polished first stretch roller and a machining cost of the first stretch roller 21 is cut considerably.

Still further, it is possible to machine the second stretch roller 22 by using the lathe in the same manner with the first stretch roller 21 by providing the straight area 22*c* on the circumferential surface of the second stretch roller 22. Then, it is also possible to enjoy the merit in terms of machining similarly to the first stretch roller 21.

Second Embodiment

Figure 7:
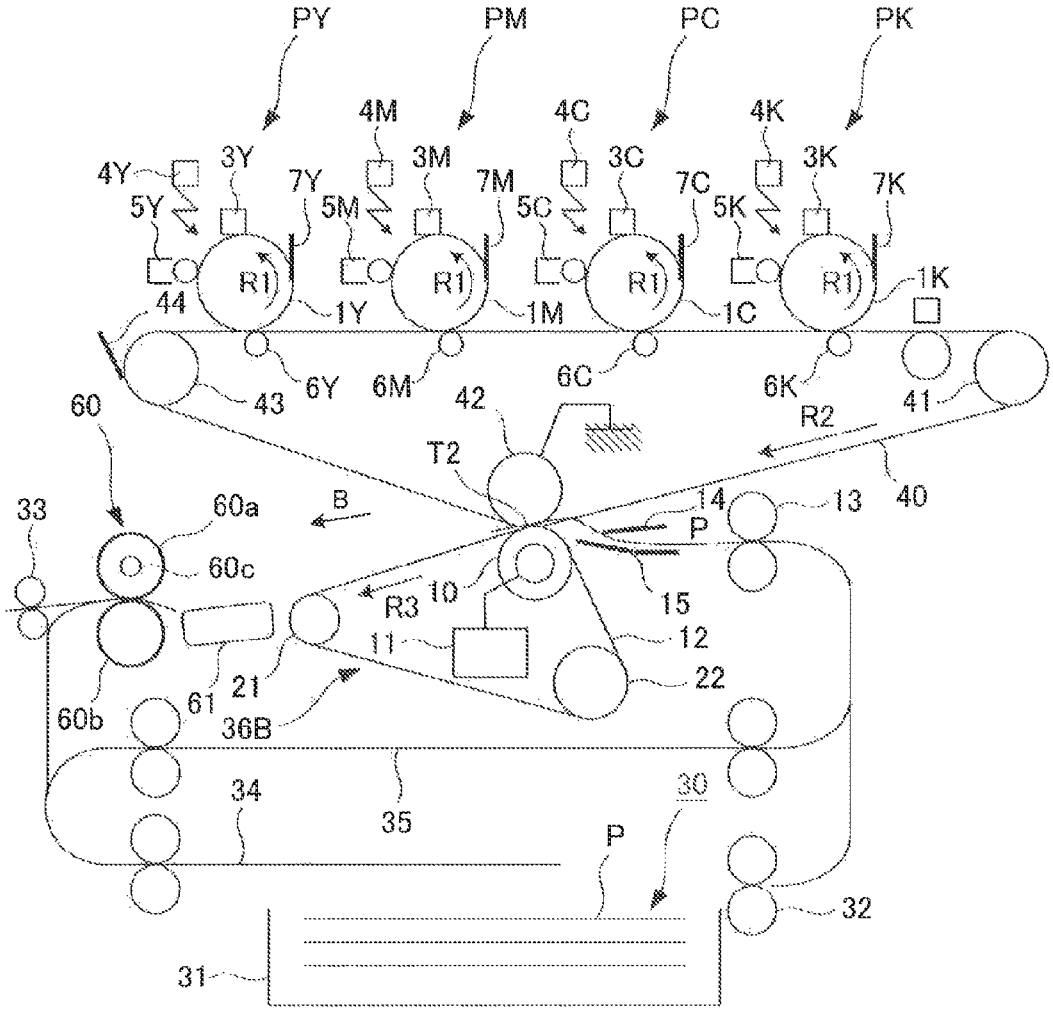
FIG. 7 is a diagram schematically illustrating a configuration of an image forming apparatus of a second embodiment.

FIG. 7 illustrates a configuration of an image forming apparatus of a second embodiment. As shown in FIG. 1, the secondary transfer belt 12 is stretched by the four stretch rollers in a trapezoidal shape in the first embodiment. However, the secondary transfer belt 12 is stretched in a triangular shape by three stretch rollers in the second embodiment. Because the configurations other than the number of stretch rollers are the same with that of the first embodiment, the components common with those in the first embodiment will be denoted by the common reference numerals shown in FIG. 1 and an overlapped explanation thereof will be omitted here.

As shown in FIG. 7, the secondary transfer belt 12 of the secondary transfer belt unit 36B is stretched by the first stretch roller 21, the second stretch roller 22, and the secondary transfer roller 10. The first stretch roller 21 that also functions as a separating roller of the secondary transfer belt 12 is disposed downstream of the secondary transfer roller 10. The second stretch roller 22 is disposed downstream of the first stretch roller 21. The secondary transfer roller 10 is disposed downstream of the second stretch roller 22.

The driving roller (23) and the driving motor (M3) driving the driving roller as disposed in the first embodiment are not provided in the second embodiment, and the secondary transfer belt 12 rotates in contact with and following to the intermediate transfer belt 40.

As shown in FIG. 4, the circumferential surface of the first stretch roller 21 is formed substantially into the shape of the normal crown. A normal crown amount ΔR1 is defined as follows, where an outer diameter of a part of the first stretch roller 21 where the outer diameter is largest is denoted by R1max and an outer diameter of a part where the outer diameter is smallest is denoted by R1min:

$$\Delta R1 = R1\max - R1\min$$

At this time, according to the second embodiment, R1min is 10 to 16 mm and ΔR1 is around 1 to 3 mm. The first stretch roller 21 functions also as the separating roller forming the curved surface for curvature-separating the recording medium P from the secondary transfer belt 12 on the secondary transfer belt 12.

As shown in FIG. 5, the circumferential surface of the second stretch roller 22 is formed substantially into the shape of inversed crown. An inversed crown amount ΔR2 is defined as follows, where, R2max is an outer diameter of a part where the outer diameter is largest of the second stretch roller 22 and R2min is an outer diameter of a part where the outer diameter is smallest:

$$\Delta R2 = R2\max - R2\min$$

At this time, in the second embodiment, R2min is 16 to 22 mm and ΔR2 is around 1 to 3 mm.

According to the second embodiment, the number of components of the secondary transfer belt unit 36B can be less than that of the first embodiment and the secondary transfer belt unit 36B can be manufactured at low cost. Although this is a simple system in which the secondary transfer roller 10 is disposed downstream of the second stretch roller 22, it is possible to suppress wrinkles otherwise generated in the secondary transfer portion T2 in the same manner with the first embodiment. It is possible to reduce inferior images caused by wrinkles in the secondary transfer portion T2 caused by waving even if the recording medium P supplied to the secondary transfer portion T2 is generating waving by passing through the fixing apparatus 60. Accordingly, the number of the stretch rollers other than the secondary transfer roller 10 can be two in order to prevent wrinkles caused by waving in the secondary transfer portion T2.

Other Embodiment

Figure 8A:
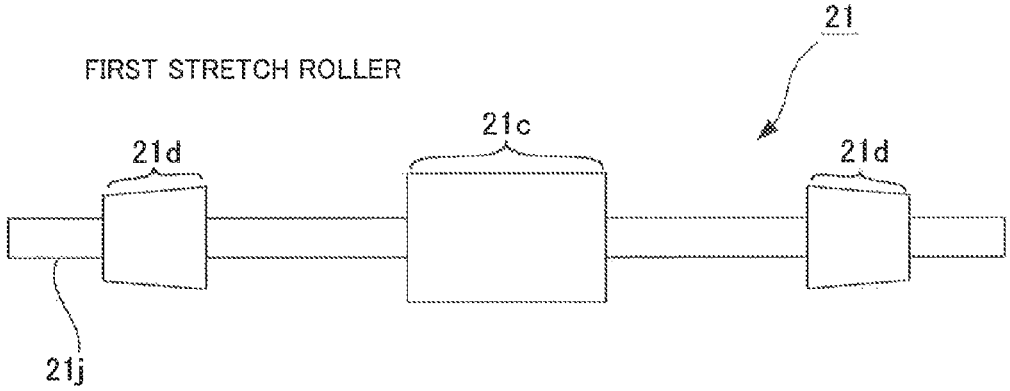
FIG. 8A illustrates one exemplary first stretch roller of another embodiment.
Figure 8B:
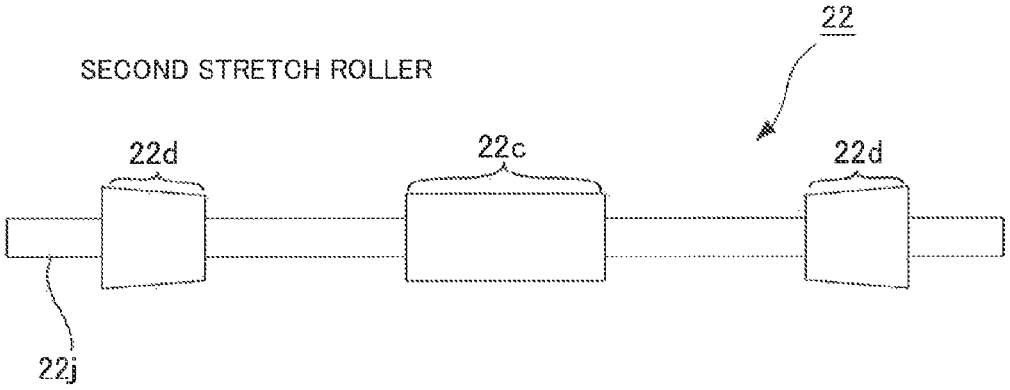
FIG. 8B illustrates one exemplary second stretch roller of another embodiment.

FIGS. 8A and 8B illustrate one example of another embodiment. The present invention is not limited to the configuration, control, material, design and size described in the first and second embodiments. The secondary transfer belt unit 36 shown in FIG. 1 may be configured by four or more stretch rollers, other than the secondary transfer roller 10. The first stretch roller 21 needs not function as the separating roller. The configuration of the first embodiment does not exhibit the effect not only in the transfer of the toner image of the second time in the duplex printing mode.

The shape of the first stretch roller 21 is not limited to the shape in which the diameter of the circumferential surface changes continuously in the direction of axis of rotation. For instance, the tapered areas 21*d* may be disposed at positions separated from the straight area 21*c* in the direction of axis of rotation as shown in FIG. 8A. Because the secondary transfer belt 12 deforms following a distribution of the diameters in the direction of axis of rotation of the first stretch roller 21, the recording medium is ribbed and the separating performance of the recording medium at the curved surface of the secondary transfer belt 12 is enhanced.

In manufacturing the first stretch roller 21, the tapered areas 21*d* of resin rollers may be fixed to the end parts and the straight area 21*c* of a resin roller may be fixed at the center part of a stainless center shaft 21*j* penetrating through the whole. In the case when the resin rollers are used, it is possible to use a complex injection molding method by which the resin is injected to a mold into which the center shaft 21*j* is assembled. It is also possible to form at least one of the straight area 21*c* and the tapered area 21*d* by a metallic roller, i.e., another member, and to assemble the first stretch roller 21 by fixing the other member to the center shaft 21*j*. It is also possible to cut out from a stainless round bar material to the appearance shown in FIG. 8A.

The shape of the second stretch roller 22 is not limited to the shape in which the diameter of the circumferential surface changes continuously in the direction of axis of rotation. For instance, the tapered areas 22*d* may be disposed at positions separated from the straight area 22*c* in the direction of axis of rotation as shown in FIG. 8B. The tapered areas 22*d* of resin rollers may be fixed to the end parts and the straight area 22*c* of a resin roller may be fixed at the center part of a stainless center shaft 22*j* penetrating through the whole. The second stretch roller 22 can be manufactured in the same manner with the first stretch roller 21.

The image carrier carrying a toner image and transferring the toner image to the recording medium P carried on the secondary transfer belt 12 is not limited to the intermediate transfer belt 40 which is just one example of an image carrier. It is also possible to configure such that a photosensitive drum or a photosensitive belt, which are another examples of the image carrier, is brought into contact with the transfer belt corresponding to the secondary transfer belt 12 to transfer the toner image from the photosensitive drum or the photosensitive belt to the transfer belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076285, filed Apr. 2, 2014 which is hereby incorporated by reference herein in its entirety.

What is claimed is:

1. An image forming apparatus comprising:

an image carrier;

a toner image forming unit configured to form a toner image on the image carrier;

an endless transfer belt configured to convey a recording medium;

a transfer roller forming a transfer portion configured to transfer the toner image on the image carrier onto the recording medium and to be urged toward the image carrier from an inner circumferential surface of the transfer belt across the transfer belt;

a first stretch roller stretching the transfer belt, disposed at a position adjacent to and downstream of the transfer portion in a moving direction of the transfer belt, and including first tapered areas disposed on both end parts in a direction of an axis of rotation thereof where the diameter is smaller than a center part in the direction of the axis of rotation thereof such that the closer to both ends, the smaller the diameter becomes;

a second stretch roller stretching the transfer belt, disposed at a position adjacent to and downstream of the first stretch roller in the moving direction of the transfer belt, and including second tapered areas disposed on both end parts in a direction of an axis of rotation thereof where the diameter is larger than a center part in the direction of the axis of rotation thereof such that the closer to both ends, the larger the diameter becomes; and a driving roller configured to drive the transfer belt, disposed at a position which is adjacent to and downstream of the second stretch roller and which is upstream of the first stretch roller, with respect to the moving direction of the transfer belt.

2. The image forming apparatus according to claim 1, wherein the first stretch roller includes a first straight area disposed at the center part in the direction of the axis of rotation thereof where a diameter is substantially constant and the second stretch roller includes a second straight area disposed at the center part in the direction of the axis of rotation thereof where a diameter is substantially constant, and wherein the first stretch roller includes the first straight area in a range corresponding to the second straight area in the direction of the axis of rotation and the first tapered areas in ranges corresponding to the second tapered areas.

3. The image forming apparatus according to claim 2, wherein the first straight area is disposed inside of respective side edges in a width direction orthogonal to a conveying direction of a smallest size recording medium conveyed to the transfer portion.

4. The image forming apparatus according to claim 2, wherein a relationship of $LT1+LT2 \leq LC1+LC2$ holds between lengths in a width direction orthogonal to a moving direction of the transfer belt wrapped around the first stretch roller, where LT1 is a length of an end part of the transfer belt wrapped around one of the first tapered areas, LT2 is a length of the end part of the transfer belt wrapped around one of the second tapered areas, LC1 is a length of a center part of the transfer belt wrapped around the first straight area, and LC2 is a length of the center part wrapped around the second straight area.

5. The image forming apparatus according to claim 1, wherein the first stretch roller has a normal crown shape in which the diameter of the first stretch roller is reduced continuously from the center part in the direction of the axis of rotation to both ends, and wherein the second stretch roller has an inversed crown shape in which the diameter of the second stretch roller is increased continuously from the center part in the direction of the axis of rotation to both ends.

6. The image forming apparatus according to claim 1, wherein the first stretch roller forms a curved surface on the transfer belt.

7. The image forming apparatus according to claim 1, wherein a part of each of the first and second stretch rollers in contact with the transfer belt is made of a metallic or resin material.

8. The image forming apparatus according to claim 1, wherein the transfer belt includes a layer formed of a resin or metallic material.

* * * * *